United States Patent [19]

Kuhl et al.

[11] 4,121,189

[45] Oct. 17, 1978

[54] ELECTRICAL RESISTOR AND METHOD OF MAKING SAME

[75] Inventors: Karl-Heinz Kuhl, Tornesch; Eberhard Muranka, Hamburg; Bernhard Schulz, Kl. Nordende; Asmund Tielens, Pinneberg, all of Fed. Rep. of Germany

[73] Assignee: TRW Inc., Cleveland, Ohio

[21] Appl. No.: 775,723

[22] Filed: Mar. 8, 1977

[30] Foreign Application Priority Data

Mar. 31, 1976 [DE] Fed. Rep. of Germany ..... 2613677

[51] Int. Cl.[2] ..... H01C 1/02

[52] U.S. Cl. ..... 338/226; 29/613; 29/614; 338/276; 338/332

[58] Field of Search ..... 338/226, 276, 322, 332, 338/334; 29/610, 613, 614, 619

[56] References Cited

U.S. PATENT DOCUMENTS

| | | | |
|---|---|---|---|
| 2,230,586 | 2/1941 | Cerny | 29/619 X |
| 2,423,021 | 6/1947 | Henckler et al. | 338/274 X |

FOREIGN PATENT DOCUMENTS

| | | | |
|---|---|---|---|
| 765,337 | 3/1934 | France | 338/332 |
| 242,718 | 5/1946 | Switzerland | 338/332 |

*Primary Examiner*—C. L. Albritton

*Attorney, Agent, or Firm*—Jacob Trachtman

[57] ABSTRACT

An electrical resistor and method of making same comprising an elongated resistor element having end sections and a resistance material extending therebetween, and a connecting part which is pressed onto at least one end section of the resistor for being bonded with the resistor element, the connecting part comprising a terminal lug having a first end section extending along and contacting an end of the resistor element and a second terminal end, and a cap received over and securing together the first end section of the terminal lug and its contacted end of the resistor element.

17 Claims, 5 Drawing Figures

ELECTRICAL RESISTOR AND METHOD OF MAKING SAME

The invention relates to an electrical wire resistor, and particularly a high load resistor, with an elongated resistor element, and connection parts which are pressed onto the end sections of the resistor element and which bond the resistor winding.

Wire resistors for electronic circuits are normally used in an "axial" or a "radial" construction. The designation "axial", and "radial", respectively, depends on the direction of the connection parts in relation to the axis of the resistor element. In the case of an axial construction, it is customary to bend over, to bend at right angles, or to generally "manufacture" the connection parts, usually wires, in such a manner as to permit the subsequent soldering of the resistor to the seat within the circuit provided for this purpose. In the case of radially constructed resistors, the connections are not "manufactured"; rather, the seat of the element within the board has been fitted beforehand to the dimensions of the element. The inherent advantage of this method consists in the fact that the elements can be mounted directly, without adjustments, into the right seat and in the right lay-out. For both methods of construction, however, an effort has to be made to ensure an adequately tight fit of the element after it has been positioned, in order to avoid having to specially hold it in position during the soldering process.

The axial method, in particular, has disadvantages, especially in the case of heavy wire resistors, as the customary connecting wires are often no longer able to carry the elements by themselves. If, in addition, in the case of the construction of a high load resistor, a certain distance between the resistor and the board must be observed in order to avoid heat damages, specific mounting difficulties will arise. Therefore, in order to securely fasten such resistors and to protect them against shock, vibrations, etc., it is customary to insert straps, springs, and other similar devices for mounting purposes.

For space purposes especially, oblong wire resistors are desirable which can be mounted parallel to the board, which in turn means a radial exit of the connections, whereby the connections should be relatively rigid without, however, impairing the bonding. With respect to the manufacturing requirements, the high load resistors which until now have been positioned vertically to the board and which can be fastened by means of special fastening devices, are superior to those of the radial execution. In connection with the latter, it has become customary to use one-piece connection parts, whereby the one end section has been designed as a cap which is slipped on and pressed onto the end section of the resistor element; the remainder of the connecting part which is in the form of a rigid lug and which stands in a nearly vertical position to the cap, serves for the attachment and establishment of the electrical connection to an attachment point in a circuit board. The fabrication of such connection parts is exceedingly costly due to the fact, on the one hand, that the tools required are complicated and expensive and, on the other, that the piece number attainable within a given period of time is, for manufacturing reasons, comparatively low. A further disadvantage consists in the fact that the quality of the bonding is not the best possible since the caps are not totally symmetrical, thereby not guaranteeing an even contact pressure on the wire winding.

The objects of the invention are, therefore, to provide a new and improved wire resistor, particularly a high load resistor for the "plug-in construction", requiring the least possible manufacturing effort, with equal or improved bonding and a new and improved method of making the same.

In the case of a resistor of the type mentioned at the beginning, this problem is solved in that the connecting part consists of a cap and a terminal lug separated therefrom, which, with its end section bent over, is pressed between the cap and the resistor material.

The invention is based on the fundamental realization that considerable advantage can be derived from separating the mechanical function of a connecting part from its electrical function, and vice-versa. For this reason, according to the invented wire resistor, the cap is an element which is separate from the terminal lug establishing the electrical connection; the cap has the exclusively mechanical function of pressing the end section of the terminal lug against the wire winding of the resistor.

The separation of the terminal lug from the cap results in a number of extraordinary advantages. The material which is best suited for a mechanical attachment can be used for the cap. The tools necessary for the fabrication of the cap can be manufactured in the normal manner, are inexpensive, and enable the utilization of high speed punching devices. The binding pressure which can be exerted on the cap can be extremely high resulting in an effective bonding of the wire resistor winding evenly across the area of the resistor where the pressure is applied.

As in the case of the cap, the most suitable material can be used for the resistor lug, for example, the relatively inexpensive electrolytical copper. The construction of the terminal lug is simple, and it is probably not necessary to go into further detail in this regard. Due to the separate construction of the cap and the terminal lug, a minimum of waste occurs during the fabrication of the parts, as opposed to the customary one-piece connecting parts mentioned previously.

Although in principle it is conceivable to manufacture the cap and the terminal lug separately and to install them separately, by which for instance the lug is welded to the cap after the latter has been pressed on, due to such subsequent welding, the quality of the bonding is negatively affected (thermal expansion, etc.).

In the case of the invention, however, the bonding occurs simultaneously with the pressing on of the cap which results, on the one hand, in a reduction in the manufacturing effort and, on the other, in a better reproductible bonding.

As already mentioned, the cap preferably consists of a mechanically firm, though easily workable material, and the terminal lug is composed of a good electrical conducting material. In this connection, a further development of the invention provides for the cap to consist of deepdrawn steel and the terminal lug to comprise of a high-percentage copper base alloy (e.g. tombac, copper/tin 90/10, phosphor bronze).

Since the cap is pressed on at high pressure, it is absolutely conceivable not to specially form the end section of the terminal lug, but to, for instance, leave it flat, the same as the remaining part. In this regard, however, a further expansion of the invention provides for a bent-over end section to be rounded and its radius to approximate that of the resistor element. In this manner, undesirable deformations of the end section are avoided and a maximum bonding is attained. A radius smaller than that of the element, however, is not desirable due to the danger of separation of the resistor wire.

A prerequisite for the effective bonding of the end section between cap and resistor winding, is for a certain length of the end section to extend into the cap. A further expansion of the invention foresees a free tip of the bent-off end section which is again bent and rests against the face of the resistor element. The free tip does not contribute towards the bonding; rather, it serves as a catch for the temporary positioning of the terminal lug, i.e. of the bent-off end section within the cap, prior to the start of the pressing operation.

A further feature of the invention provides for the cap to be pressed at such a high pressure that a cold-welding connection results between the resistor material and the end section. For this purpose, it is advantageous for the terminal lug to be covered with a metal coating conductive to a cold-welding connection, preferably tin or a lead/tin alloy. In the latter case, the alloy's content may consist of approximately 70% lead and 30% tin. The cold-welding connection, i.e., a pressure welding connection without external heat supply, guarantees outstanding bonding with simultaneous, effective anchorage of the terminal lug to the resistor.

High load wire resistors of the above-described type are often covered with a coating of protective lacquer, cement or glaze. In many cases, however, they are housed in ceramic envelopes which are equipped with an axial bore hole into which the resistor element is inserted. In this connection, a further feature of the invention foresees for the terminal lug to be provided with a constricted section which extends through a longitudinal groove of the ceramic envelope which is connected with the longitudinal bore hole. The longitudinal groove within the ceramic envelope enables the insertion of the resistor element with radially stand-off terminal lugs, whereby the longitudinal groove is designed in such a manner as to permit the constricted section of the lug to be fed therethrough without the risk of the whole element falling out prior to its being embedded, with the appropriate material, within the bore hole of the ceramic envelope. In order to avoid loss of rigidity resulting from the punching out of the recesses to provide the constrictions, a further feature of the invention provides in this connection for the constricted section to be formed with a one-sided or two-sided bead along the flat terminal lug (not shown). In this manner, the rigidity of the terminal lug within this section is considerably increased.

The invention is described in connection with the drawing, in which.

Figure 1:
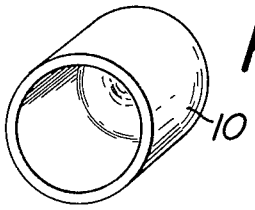
FIG. 1, is a perspective view of a cap of a resistor embodying the invention.
Figure 2:
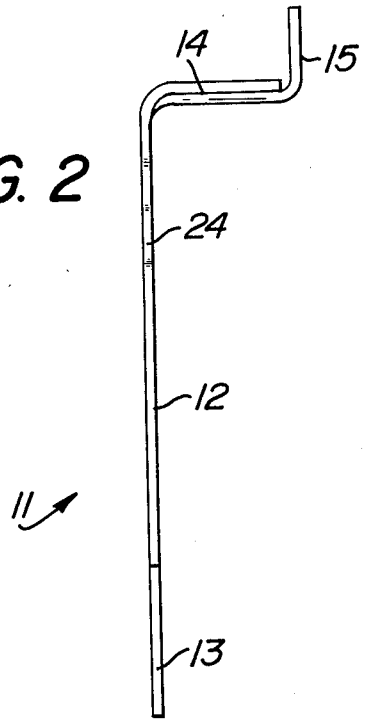
FIG. 2, is a side view of a terminal lug.
Figure 3:
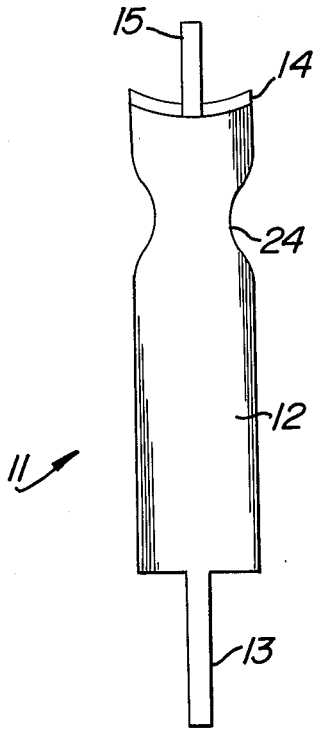
FIG. 3, is a top plan view of the terminal lug shown in FIG. 2.
Figure 4:
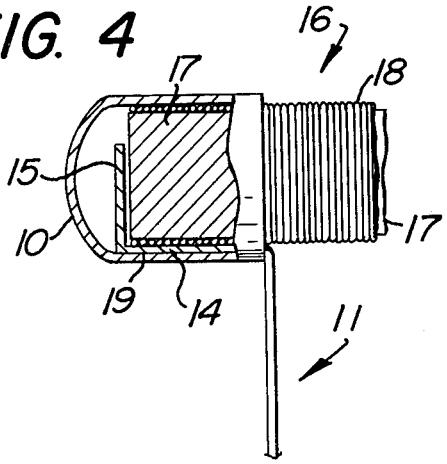
FIG. 4, illustrates an end of a wire resistor embodying the invention with parts broken away and in sections, including the cap and terminal lug of FIGS. 1 and 2, and FIG. 5, is a perspective view illustrating a portion of the wire resistor embedded in a ceramic envelope.

The wire resistor of the invention includes a cap 10 of deep-drawn steel which is shown in FIG. 1. It is manufactured by pressure-shaping from a flat blank by means of customary tools and presses. FIGS. 2 and 3 show a terminal lug 11 which may be made, for example, of electrolytical copper. The terminal lug is also fabricated by means of simple stamping and bending processes and consists of a straight, flat support section 12 with an entrance tab 13 at the lower end for insertion into preformed holes of a circuit board. At the upper end of the support section 12, an end section 14 is bent over, practically rectangularly, and at the same time is vaulted, as shown in FIG. 3. At the free end of the end section 14, a catch 15 is bent upward, again practically rectangularly. FIG. 4 shows a high load wire resistor 16, with a support body 17 made of a somewhat elastic material, onto which a wire winding 18 has been wound. For a clearer outline, the left-hand end of the resistor element 16 is shown in section. The cap 10 is drawn over the end of the resistor element 16; the end section 14 and the catch 15 are located adjoining to the end face of the resistor element 16. Thus, the length of the end section 14 determines the depth to which the cap 10 is seated over the end section of the resistor element 16. After this has occurred, pressure is applied to the cap 10 with an appropriate pressure tool, resulting in a weld, at 19, between the cap 10 and the end section 14, due to the high pressure exerted. In this manner, the end section 14 is also effectively bonded with the coil 18.

Figure 5:
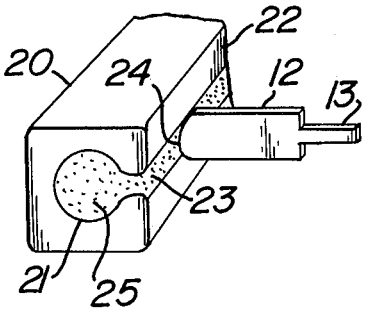

The resistor configuration shown in FIG. 4 can, as shown in FIG. 5, be inserted into a ceramic envelope 20, which has an axial bore hole 21. One side 22 of the envelope 20 is provided with a longitudinal groove 23 through which the constricted portion 24 of the supporting section 12 (see FIG. 3) can be received. The longitudinal groove 23 which communicated with the bore hole 21 enables the axial insertion of the resistor configuration without the resistor falling out prior to filling the hole 21 with a bonding material 25.

It should be mentioned that the terminal lug 11, in addition to being fabricated by being stamped or cut out, can also be made by beading the support section 12, for obtaining an increased rigidity.

It will be obvious to those skilled in the art that the invention may find wide application with appropriate modification to meet the individual design circumstances, but without substantial departure from the essence of the invention.

What is claimed is:

1. An electrical resistor comprising an elongated resistor element having end sections and a resistance material extending therebetween, and a connecting part which is pressed onto at least one end section of the resistor for being bonded with the resistor element, the connecting part comprising a terminal lug of electrically conductive material having a first end section along and contacting an end of the resistor element and a second terminal end, and a cap of mechanically firm, easily workable material received over and securing together the first end section of the terminal lug and the end of the resistor element contacted by said first end section, the cap being composed of deep-drawn steel and the terminal lug being of a high-percentage copper alloy.

2. An electrical resistor in accordance with claim 1, in which the end section of the terminal lug is bent with respect to its terminal end and has a shape which approximates the exterior configuration of the end of the resistor element which it contacts for providing a good electrical connection with the end of the resistor element.

3. An electrical resistor in accordance with claim 1, in which the resistor element has an end face and the end section of the terminal lug has a first section extending along and contacting the end of the resistor element and a second free end section which is bent with respect to the first section and rests adjacent to the face of the resistor element.

4. An electrical resistor in accordance with claim 3, including a ceramic envelope having a longitudinally extending bore hole receiving the resistor element therein, a longitudinal groove communicating with said bore hole through which the terminal lug extends, and the terminal end is provided with a constricted portion positioned at the location where the terminal end extends through the groove of the envelope.

5. An electrical resistor in accordance with claim 4, in which a cold-welding connection secures the cap with the bent section of the terminal lug.

6. An electrical resistor in accordance with claim 1, in which a cold-welding connection secures the bent section of the terminal lug with the resistor element.

7. An electrical resistor in accordance with claim 5, in which the resistance material of the resistor element is a wire coil and a cold-welding connection secures the bent section of the terminal lug with the wire coil.

8. An electrical resistor in accordance with claim 7, in which the terminal lug has a metal coating selected from the group of metals consisting of tin and lead-tin alloy.

9. An electrical resistor in accordance with claim 1, in which the resistance material of the resistor element is a wire coil with a core providing limited elasticity.

10. An electrical resistor in accordance with claim 6, in which the resistance material of the resistor element is a wire coil with a core providing limited elasticity.

11. A method of making a resistor having an elongated resistor element with a resistance material extending between its ends and terminating means at one of its ends which includes the steps of (a) positioning an end of a terminal lug of electrically conductive material along and contacting the resistance material on an end elongated resistor element, (b) positioning a cap of mechanically firm, easily workable material over the end of the resistor element and the end of the terminal lug, and (c) applying pressure to the cap to secure together and provide a connection between the cap, end of the terminal lug, and the end of the resistor element.

12. The method in accordance with claim 11 in which the resistor is a wire wound resistor having a coil extending between the ends of said resistor element.

13. The method in accordance with claim 11 in which the cap is made of steel and the terminal lug is an alloy with a high percentage of copper.

14. The method in accordance with claim 13 in which the end of the terminal lug has a cold-weldable metal coating, and the pressure applied in step (c) above is sufficient to form a cold-weld connection between the cap and the end of the terminal lug.

15. The method in accordance with claim 13 in which the end of the terminal lug has a cold-weldable metal coating, and the pressure applied in step (c) above is sufficient to form a cold-weld connection between the end of the terminal lug and the coil of the resistor.

16. The method in accordance with claim 14 in which the end of the terminal lug has a cold-weldable metal coating, and the pressure applied in step (c) above is sufficient to form a cold-weld connection between the end of the terminal lug and the coil of the resistor.

17. The method in accordance with claim 16 in which the metal coating is selected from the group of metals consisting of tin and lead-tin alloy.

* * * * *

UNITED STATES PATENT AND TRADEMARK OFFICE

CERTIFICATE OF CORRECTION

PATENT NO. : 4,121,189

DATED : October 17, 1978

INVENTOR(S) : Karl-Heinz Kuhl, Eberhard Muranka, Bernhard Schulz and Asmund Tielens It is certified that error appears in the above-identified patent and that said Letters Patent are hereby corrected as shown below:

Column 6, line 5; before "elongated" insert - of an -

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*